US006182844B1

(12) United States Patent
Monzen et al.

(10) Patent No.: US 6,182,844 B1
(45) Date of Patent: Feb. 6, 2001

(54) SWAYING HOISTED LOAD-PIECE DAMPING CONTROL APPARATUS

(75) Inventors: Tadaaki Monzen; Susumu Kouno; Takashi Toyohara, all of Tokyo; Yoshiaki Okubo, Hiroshima; Noriaki Miyata, Tokyo, all of (JP)

(73) Assignee: Mitsubishi Jukogyo Kabushiki Kaisha, Tokyo (JP)

( * ) Notice: Under 35 U.S.C. 154(b), the term of this patent shall be extended for 0 days.

(21) Appl. No.: 09/628,642

(22) Filed: Jul. 31, 2000

Related U.S. Application Data

(60) Division of application No. 08/948,122, filed on Oct. 9, 1997, which is a continuation-in-part of application No. 08/412,299, filed on Mar. 28, 1995, now abandoned.

(30) Foreign Application Priority Data

Mar. 28, 1997 (JP) ..... 56872

(51) Int. Cl.[7] ..... B66C 13/08; B66C 17/00
(52) U.S. Cl. ..... 212/274; 212/272
(58) Field of Search ..... 212/272–274, 212/312, 316, 321

(56) References Cited

U.S. PATENT DOCUMENTS 4,531,647 * 7/1985 Higuchi et al. ..... 212/274
5,909,817 * 6/1999 Wallace, Jr. et al. ..... 212/273

FOREIGN PATENT DOCUMENTS

3412827 * 10/1985 (DE) ..... 212/274
1129174 * 12/1984 (GB) ..... 212/272
1208003 * 1/1986 (GB) ..... 212/273
54-17249 * 2/1979 (JP) ..... 212/274

* cited by examiner

*Primary Examiner*—Robert P. Olszewski
*Assistant Examiner*—R. B. Johnson
(74) *Attorney, Agent, or Firm*—Trop, Pruner & Hu, P.C.

(57) ABSTRACT

A transverse trolley 11 is transversally movable on a crane girder. A driver is provided for the transverse trolley 11. A pair of sheave blocks 14, 15 which is movable relative to a transverse trolley 11 are disposed on both (right and left) sides of a transverse trolley 11. Drivers are provided for the sheave blocks. Detectors 31 through 38 are provided which detect the displacement and velocity of the transverse trolley 11, the sway displacement and velocity of a hoisted load-piece 23 on both (right and left) sides and the displacement and velocity of the two sheave blocks 14, 15. A notch is disposed on an operation controlling panel of the transverse trolley 11 for setting a trolley transverse velocity by an operator. A transverse notch-driving control quantity detector 40 is provided which outputs signals indicative of notch-driving control quantity (a trolley transverse velocity set value) which is set by operating the notch. A controller is provided which effects sway-damping control of the load-piece hoisting device based on detection signals obtained from the detectors 31 through 38 and 40, and an optimizing control unit performs sway-damping control with optimal controlling quantities on the basis of a preset optimal gain K in accordance with the displacement and velocity and the notch-driving control quantity.

1 Claim, 9 Drawing Sheets

$$x = \begin{bmatrix} x_0 \\ \dot{x}_0 \\ x_1 \\ \dot{x}_1 \\ x_2 \\ \dot{x}_2 \\ d_1 \\ \dot{d}_1 \\ d_2 \\ \dot{d}_2 \end{bmatrix} \quad x_r = \begin{bmatrix} 0 \\ v_0 \\ 0 \\ 0 \\ 0 \\ 0 \\ 0 \\ 0 \\ 0 \\ 0 \end{bmatrix} \quad \psi = \begin{bmatrix} v_0 \\ 0 \\ 0 \end{bmatrix} \quad u = \begin{bmatrix} u_0 \\ u_1 \\ u_2 \end{bmatrix} \quad G_1 = \begin{bmatrix} 0 \\ 1 \\ 0 \\ 0 \\ 0 \\ 0 \\ 0 \\ 0 \\ 0 \\ 0 \end{bmatrix} \quad G_2 = \begin{bmatrix} 1 \\ 0 \\ 0 \end{bmatrix}$$

$M_0$ : Mass of trolley
$M_0$ : Mass of left sheave
$m$ : Mass of load
$x_0$ : Trolley position
$x_1$ : Left sheave position
$d_1$ : Left load position
$\psi$ : Skew angle
$f_0$ : Tractive force of trolley
$f_1$ : Drive force of left sheave
$f_2$ : Drive force of right sheave $M_2$ : Mass of right sheave
$I$ : Inersia of load
$x_2$ : Right sheave position
$d_2$ : Right load position
$r$ : load length

SWAYING HOISTED LOAD-PIECE DAMPING CONTROL APPARATUS

This application is a divisional and continuation-in-part of application Ser. No. 08/948,122 filed Oct. 9, 1997 which is a continuation-in-part of application Ser. No. 08/412,299 filed Mar. 28, 1995 now abandoned.

FIELD OF THE INVENTION AND RELATED ART STATEMENT (1) Field of the Invention

The present invention relates to a swaying hoisted load-piece damping control apparatus, and more detailedly relates to a swaying hoisted load-piece damping control apparatus for a load-piece hoisting device used in a large-scale load-piece lifting container crane and the like.

(2) Description of the Prior Art

FIG. 6 shows an overall configuration of a swaying hoisted load-piece damping apparatus for use in a conventional container crane and FIG. 7 shows operating states of the conventional swaying hoisted load-piece damping apparatus.

As shown in FIG. 6, a transverse trolley 11 is provided transversally movable (movable in the side-to-side directions in FIG. 6 on main crane girder 29. The transverse trolley 11 has a pair of rails 12 and 13 thereon which guide a pair of sheave blocks 14 and 15, respectively so that the sheave blocks 14 and 15 can move within short range in parallel with the moving direction of the transverse trolley 11. The transverse trolley 11 is connected through a wire 16 to a trolley driver 17 disposed on the main girder (not shown) on which the transverse trolley 11 moves. The sheave blocks 14 and 15 have respective sheave block drivers 18 and 19 for driving the sheave blocks 14 and 15. A hoisting attachment 22 is hanged from the transverse trolley 11 through winding wires 20. This hoisting attachment 22 hoists a container 23 as a hoisted load-piece. Here, as shown in FIG. 6, the hoisting attachment 22 has a detecting mark 21 for detecting the sway of the hoisted load-piece on the upper surface thereof.

In stopping the sway of such a load-piece hoisting device, the operator in the operator cab, visually observing the motion of the hoisting attachment 22, used to perform manual remote-control operations in the following manner.

That is, in the state shown in FIG. 6, when the trolley drivers 17 drives the transverse trolley 11 from the left to the right in a direction shown by an arrow $\alpha$, if the movement of the transverse trolley 11 is changed from the constant-speed transverse travel mode to the retarding travel mode, the hoisted load-piece 23 hanged by the hoisting attachment 22 sways rightward (forward) due to its inertia, as indicated by an arrow $\beta$ in FIG. 7(*a*). At that moment, as the operator in the operator cab watches the detecting mark 21 on the hoisting attachment 22 and perceives the sway, the operator controls the transverse trolley 11 to accelerate as indicated by an arrow $\alpha$ in FIG. 7(*b*), in conformity with the transverse sway of the hoisted load-piece 23 (in the aforementioned direction of the arrow $\alpha$). Alternatively, the two sheave blocks 14, 15 may be controlled to move in the same direction with the swaying direction of the hoisted load-piece 23 by activating the left and right sheave block drivers 18, 19 on the transverse trolley 11. Thereafter, the operator tries to control the transverse trolley 11 to retard in time with the reverse motion of the hoisted load-piece 23 after the trolley completes a rightward (forward)-swing of a certain magnitude or should control the sheave blocks 14, 15 to move in the opposite direction to the aforementioned direction so that the transversally swinging load-piece is dampened to stop.

In the case shown in FIG. 6, if, for example, the hoisted load-piece 23 slues clockwise causing skew sway on a plane as indicated by arrows A, the operator again perceives it from the movement of the detecting mark 21 and activates the driver 18, 19 so as to move the sheave block 15 leftward (in the direction shown by an arrow B) and the other sheave block 14 rightward (in the direction shown by an arrow C) in synchronism with the skew sway. To deal with a repulsive swing of the hoisted load-piece 23, the sheave blocks 14, 15 may and should be driven in the opposite directions to those described above, so that the skew sway is attenuated to stop.

The conventional, swaying hoisted load-piece damping apparatus in which sway is manually stopped by the operator, however, suffers from problems as follows.

That is, as stated above, it is true that simple transverse sway or simple skew sway of the hoisted load-piece 23 can be attenuated and stopped by the operator by accelerating and/or retarding the transverse trolley 11 or by moving the sheave blocks 14,15 in synchronism with the swinging state of the hoisting attachment 22. But, if transverse sway and skew sway occur at the same time and cause the hoisted load-piece 23 to make a complex motion, it becomes difficult or practically impossible for the operator to manually drive the transverse trolley 11 or the sheave blocks 14, 15 well enough to deal with the situation.

As soon as the hoisted load-piece 23 is stopped to sway, the sheave blocks must normally be returned by force to their home positions or the middle of the transverse trolley 11 with respect to the transverse direction, so that the two (left and right) sheaves 14 and 15 can move in either transverse direction to prepare for a next swing of the hoisted load-piece 23. In order to improve the efficiency of conveying the hoisted load-piece 23, the transverse trolley 11 must be driven at a maximum speed during it travels transversally. When the hoisted load-piece 23 comes near a target position where it is to be unloaded onto the ground, the transverse trolley 11 should be retarded so as to stop at the target position and then need be stopped at the target position where the load-piece is unloaded. To sum up, it is necessary to effect, all at once, position control of the sheave blocks 14 and 15, velocity and/or position control of the transverse trolley 11 in conformity with the transverse position and conditions, other than the control of damping the swaying hoisted load-piece 23. Nevertheless, since the conventional sway-damping operation is manually effected by the operator, the controlling operation requires the toughest techniques for even the skilled operators.

OBJECT AND SUMMARY OF THE INVENTION

The present invention has been achieved to solve the above problems and it is therefore an object of the present invention to provide a swaying hoisted load-piece damping control apparatus which simplifies the operation of damping swaying hoisted load-piece and is able to achieve the damping operation in an assured manner.

Another object of the present invention is to provide a swaying hoisted load-piece damping control apparatus which is able to realize an optimal control for damping and stopping a swaying hoisted load-piece as fast as possible by automating the complicated swaying hoisted load-piece damping operation.

A further object of the present invention is to provide a swaying hoisted load-piece damping control apparatus which is able to improve the work efficiency of conveying hoisted load-pieces by markedly reducing the work amount of the operator and the time required for sway damping.

In order to attain the above objects, a swaying hoisted load-piece damping control apparatus (an apparatus defined in claim 1) for use in a load-piece hoisting device having a transverse trolley for hoisting a load-piece being transversally movable on a crane girder and the driver thereof, and a pair of, or right and left, sheave blocks which are disposed along moving directions of said transverse trolley in parallel with the sides of said transverse trolley and movable relative to said transverse trolley and the drivers thereof, comprises: trolley displacement/velocity detectors for detecting a displacement and a velocity of said transverse trolley; sway detectors for detecting the displacement and velocity of a sway on right and left sides of the load-piece hoisted by said transverse trolley; sheave-block displacement/velocity detectors for detecting the displacement and velocity of said right and left sheave blocks; a notch disposed on an operation controlling panel of said transverse trolley, for setting a trolley transverse velocity by an operator; a notch-driving operation quantity detector for outputting signals indicative of notch-driving operation quantity (a trolley transverse velocity set value) which is set by operating said notch; and a controller for effecting sway-damping control of said load-piece hoisting device based on detection signals obtained from said detectors, characterized in that said controller has an optimizing control unit which sets up optimal controlling quantities for the hoisted load-piece in accordance with the displacement and velocity and notch-driving operation quantity detected from said detectors, on the basis of a preset optimal gain for sway damping, and performs sway-damping control by driving said transverse trolley and said sheave blocks in accordance with the setup optimal controlling quantities.

According to the present invention, in the swaying hoisted load-piece damping control apparatus defined in claim 1, the controller comprises: an operating condition determining unit which detects the operating condition of the transverse trolley, based on the displacement and velocity and the notch-driving operation quantity for said transverse trolley; an operating-condition-classifying optimal-gain selecting unit which, in accordance with the operating condition detected by the operating condition determining unit, selects an operating-condition-classifying optimal gain for sway damping from a plurality of predetermined optimal gains; and an optimizing control unit which, based on the optimal gain outputted from the operating-condition-classifying optimal-gain selecting unit, sets up optimal controlling quantities for the hoisted load-piece and performs sway-damping control by driving the transverse trolley and the sheave blocks in accordance with the setup optimal controlling quantities.

According to the present invention, in the swaying hoisted load-piece damping control apparatus defined in claim 1, the controller comprises: an independently controlling optimal-gain calculating unit which drives said transverse trolley and said sheave blocks so as to damp transverse sway and skew sway, respectively, that is, calculates independent optimal gains used to control transverse sway and skew sway of the hoisted load-piece, independently one from the other by separate drivers and outputs the calculated optimal gains; and an optimizing control unit for effecting sway-damping control which, based on the optimal gains outputted from said independently controlling optimal-gain calculating unit, sets up optimal controlling quantities for hoisted load-piece and performs sway-damping control by driving said transverse trolley to damp transverse sway of the load-piece and driving said right and left sheave blocks to damp skew sway of the load-piece.

According to the present invention, in the swaying hoisted load-piece damping control apparatus defined in claim 1, the controller comprises: an independently controlling optimal-gain calculating unit which calculates independent optimal gains used to control transverse sway and skew sway of the hoisted load-piece, independently one from the other and outputs the calculated optimal gains; an operating condition determining unit which detects the operating condition of the transverse trolley, based on the displacement and velocity and the notch-driving operation quantity for said transverse trolley; an operating-condition-classifying optimal-gain selecting unit which, in accordance with the operating condition detected by the operating condition determining unit, selects a preset operating-condition-classifying optimal gain or an operating-condition-classifying optimal gain set up by the independently controlling optimal-gain calculating unit and outputs the selected gain; and an optimizing control unit which, based on the optimal gain outputted from the operating-condition-classifying optimal-gain selecting unit, sets up optimal controlling quantities for the hoisted load-piece and performs sway-damping control by driving the transverse trolley and the sheave blocks in accordance with the setup optimal controlling quantities.

In accordance with the swaying hoisted load-piece damping control apparatus of the present invention, as the container crane is activated, detection signals are detected by the transverse trolley displacement/velocity detectors, the right-and-left-sheave-block displacement/velocity detectors, the hoisted load-piece sway detectors for detecting the sway on right and left sides of the load-piece and the notch-driving operation quantity detector. The thus detected signals are sent to the controller. In the controller, an optimal gain for sway damping is previously determined, and then the optimizing control unit effects sway-damping control by driving the transverse trolley and the sheave blocks by optimal controlling quantities calculated on the basis of the optimal gain and the signals detected by the detectors.

The operating condition determining unit, based on the signals from the transverse trolley displacement/velocity detectors and from the notch-driving operation quantity detector, determines which condition the transverse trolley is in, specifically, the condition in which the transverse trolley travels, the condition in which the trolley is retarded for positioning or the condition in which the trolley is stopped with the hoisted load-piece swaying alone. The determined signal is outputted to the operating-condition-classifying optimal gain selecting unit. This operating-condition-classifying optimal gain selecting unit, as receiving the determine signal, selects any one of optimal gains previously set up according to plural classifying operating conditions and outputs the thus selected optimal gain to the optimizing control unit. The optimizing control unit sets up an optimal controlling quantity calculated on the basis of the selected optimal gain and the signals detected by the detectors and drives the transverse trolley and the sheave blocks by the thus set up by optimal controlling quantities, to thereby perform sway-damping control.

The independently controlling optimal gain calculating unit calculates an optimal gain which realizes a task allocation of the transverse trolley and the sheave blocks, namely, drives the transverse trolley and the sheave blocks for damping transverse sway and skew sway of the hoisted load-piece, respectively, so as to output it to the optimizing control unit. The optimizing control unit effects sway-damping control by driving the transverse trolley and the sheave blocks by the optimal controlling quantity calculated on the basis of the optimal gain and the signals detected by the detectors.

The independently controlling optimal gain calculating unit calculates an optimal gain which realizes the task allocation of the transverse trolley and the sheave blocks, namely, drives the transverse trolley and the sheave blocks for damping transverse sway and skew sway of the hoisted load-piece, respectively, so as to output it to the operating-condition-classifying optimal gain selecting unit while the operating condition determining unit, based on the signals from the transverse trolley displacement/velocity detectors and from the notch-driving operation quantity detector, determines which condition the transverse trolley is in, specifically, the condition in which the transverse trolley travels, the condition in which the trolley is retarded for positioning or the condition in which the trolley is stopped with the hoisted load-piece swaying alone and outputs the determined signal to the operating-condition-classifying optimal gain selecting unit. The operating-condition-classifying optimal gain selecting unit, as receiving these determined signals, selects one of the optical gains classified according to the operating condition and outputs it as an optical gain to the optimizing control unit. The optimizing control unit effects sway-damping control by driving the transverse trolley and the sheave blocks by the optimal controlling quantity calculated on the basis of the optimal gain and the signals detected by the detectors.

DETAILED DESCRIPTION OF PREFERRED EMBODIMENTS

Embodiments of the present invention will hereinafter be described in detail with reference to FIGS. 1 through 5.

Figure 1:
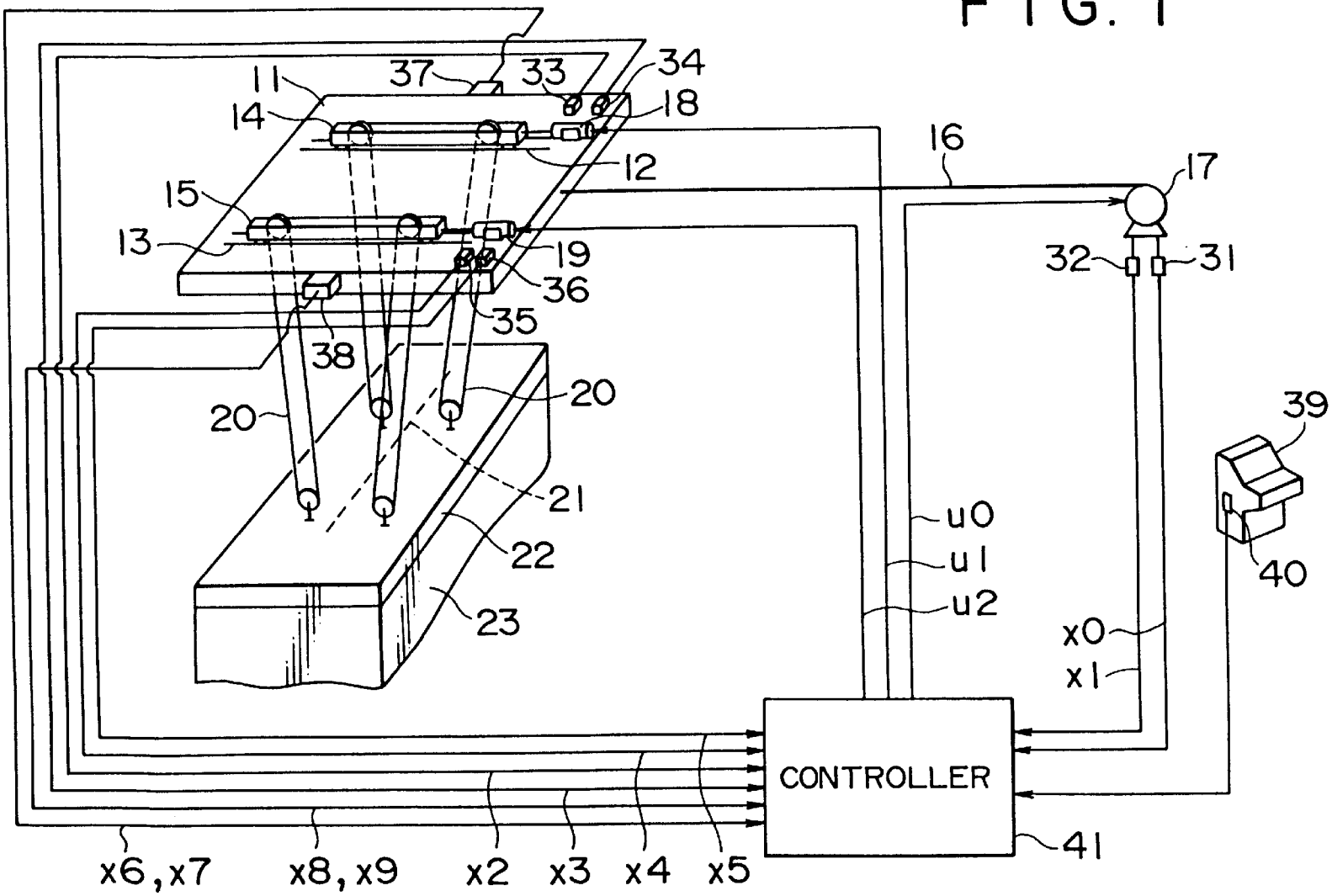
FIG. 1 is a schematic constructional view showing an overall configuration of a swaying hoisted load-piece damping control apparatus in accordance with an embodiment of the present invention.
Figure 2:
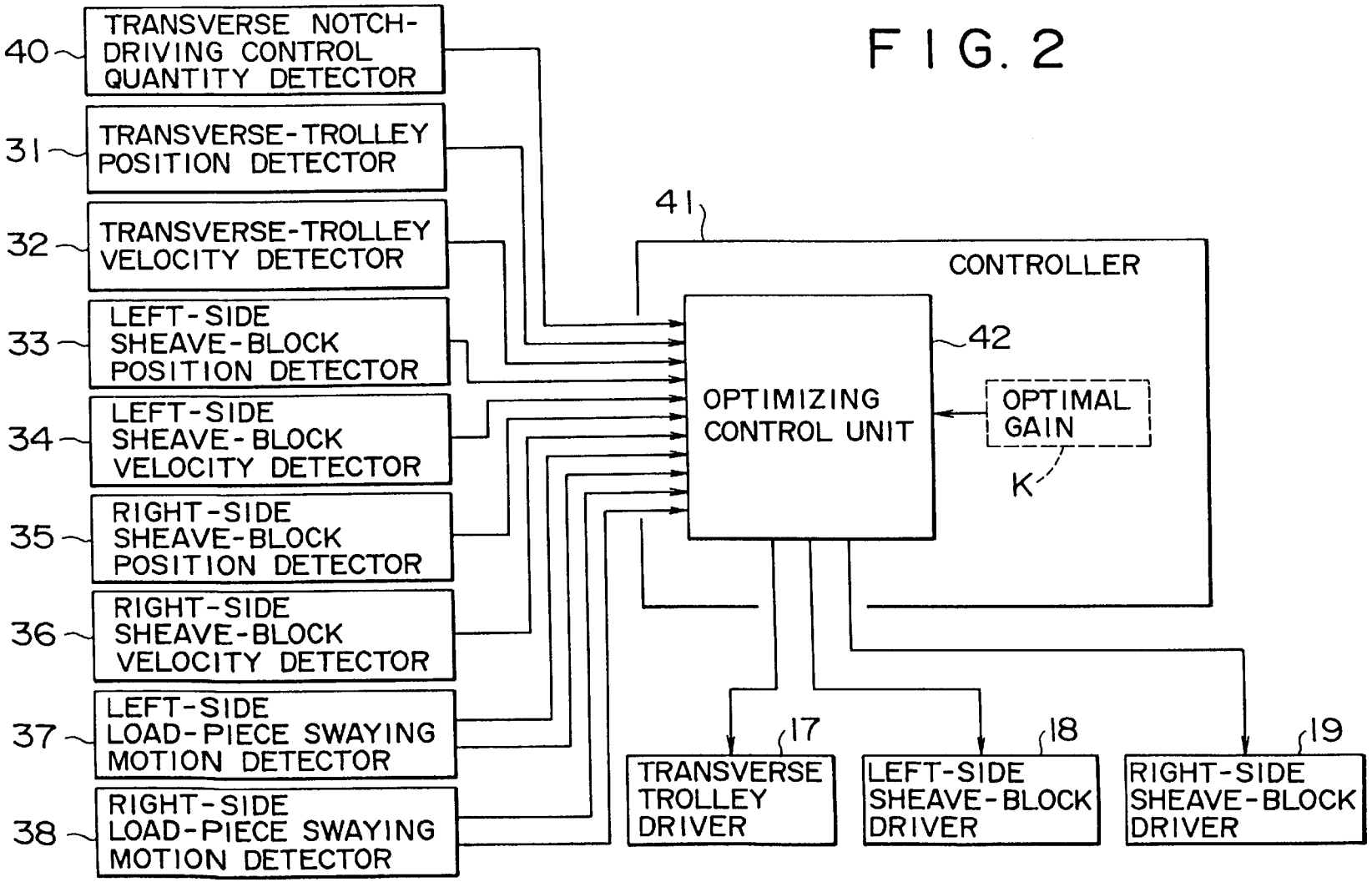
FIG. 2 is a block diagram showing a first embodiment of a controlling apparatus.
Figure 6:
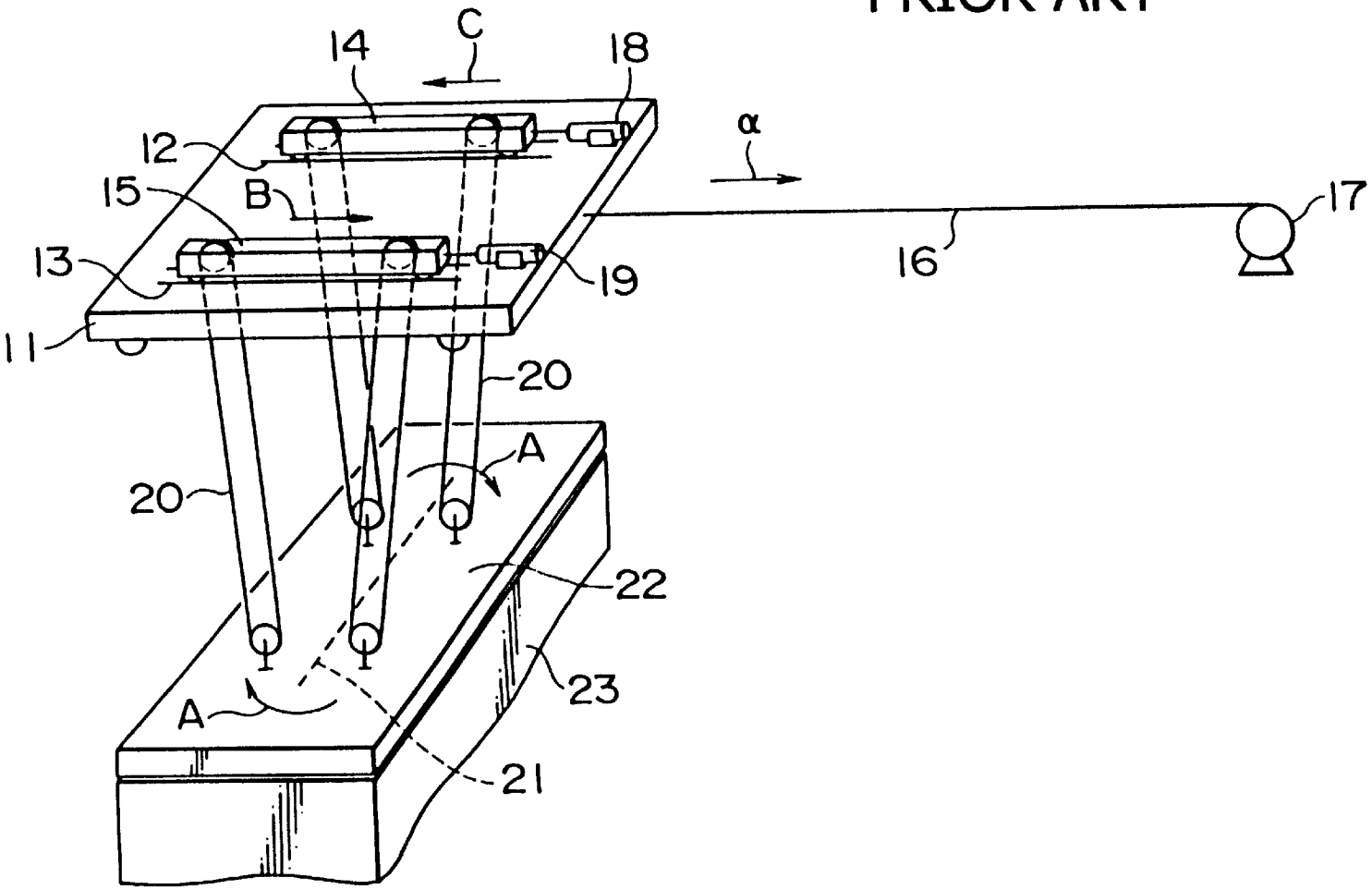
FIG. 6 PRIOR ART
FIG. 6 is a schematic view showing a conventional swaying hoisted load-piece damping apparatus for use in a prior art container crane.
Figure 7A:
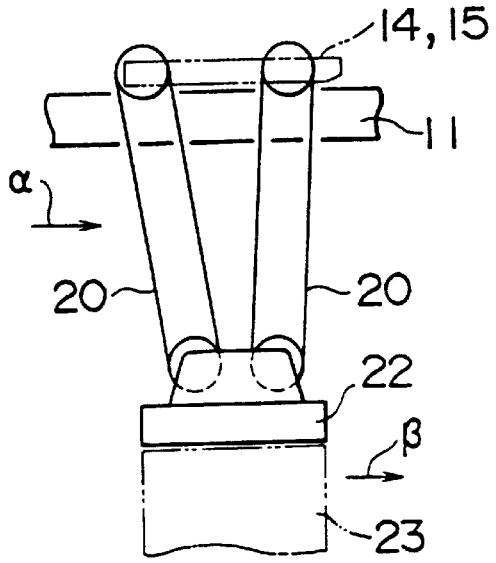
FIG. 7a PRIOR ART
FIGS. 7*a* and *b* show illustrations of operating conditions of the conventional swaying hoisted load-piece damping apparatus.
Figure 7B:
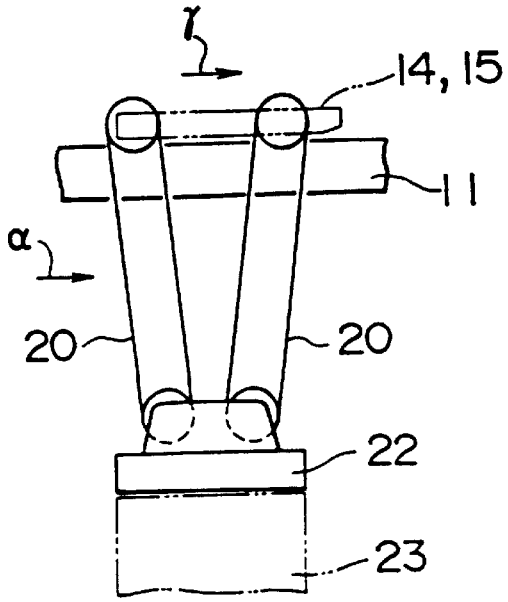
FIG. 7b PRIOR ART

FIG. 1 schematically shows an overall configuration of a swaying hoisted load-piece damping control apparatus in accordance with an embodiment of the present invention. FIG. 2 is a controlling block for explaining a first embodiment of a controlling apparatus. In FIG. 1, identical reference numerals are allotted to components having the same functions with those in the prior art shown in FIG. 6 and repeated description for those is omitted.

As shown in FIG. 1, in a controlling apparatus for damping a swaying hoisted load-piece of this embodiment, the trolley driver 17 of the transverse trolley 11 includes a position or displacement detector 31 and a velocity detector 32 for the trolley. The left-side sheave block 14 is provided with a displacement detector 33 and a velocity detector 34 for the sheave blocks. In the same manner, the right-side sheave block 15 is provided with a displacement detector 35 and a velocity detector 36. In order to detect sway of the hoisted load-piece, sway detectors 37, 38 and provided respectively on left and right sides of the traverse trolley 11 so as to check the motion of the detecting mark 21 on the hoisting attachment 22 and thereby detect left-side and right-side swaying displacements and velocities of the hoisted load-piece 23.

A traverse operation controlling panel 39 in the crane operator cab includes a gear shift lever in a notch for setting a trolley traverse velocity by changing gear settings. A notch-driving operation quantity detector 40 outputs signals indicative of a notch-driving operation quantity that the operator sets up by operating the gear shift lever. The detector 40 detects integral values "0", "1", "2" . . . as notch-driving operation quantities. Each value corresponds to a gear selection (i.e. neutral gear ("0"), low gear ("1"), second gear ("2")).

Each of the detectors will be described below.

Motors are used as the drivers for the traverse trolley and right and left sheave blocks. For the traverse trolley, the motor rotates a drum around which a wire 16 is wound so as to wind up or off the wire, thereby allowing the traverse trolley to traversely move on a crane girder. For the sheave blocks, the motor rotates a ball screw so as to slide the sheave blocks on the ball screw. Here, a rotating angle and a rotating velocity of the motor are proportional to a motion displacement and a motion velocity of the traverse trolley and sheave blocks.

On the other hand, the commercially-available motor is equipped with an encoder for detecting the rotating angle and a pulse generator for detecting the rotating-angle velocity so that the rotating angle and the rotating-angle velocity can be detected.

In the transverse trolley and left and right sheave blocks, the signals, which are detected by the encoder and pulse generator attached to each motor, are therefore proportional signal to the motion displacement and velocity. That is, these are detectors for detecting the displacement and velocity of the transverse trolley and left and right sheave blocks.

A sway detector comprises a CCD camera and an image processing apparatus. The detecting mark on the hoisting attachment is picked up by the CCD camera. The mark is then transmitted to the image processing apparatus as an image signal whose luminance is changed by a certain pixel. In the image processing apparatus, an image signal luminance change position is detected so as to detect a mark position, that is, sway displacement. The sway displacement is calculated during the interval between the previous time and the current time so as to detect a sway velocity.

A controller 41 is to receive detection signals $x_0$, $*x_0$, $x_1$, $*x_1$, $x_2$, $*x_2$, $d_1$, $*d_1$, $d_2$, $*d_2$ and $v_0$ from all the detectors 31 through 38 and the notch-driving operation quantity detector 40 . The controller 41 is also to calculate, based on an optimal gain /K for sway damping which is previously calculated and set up separately in the controller as shown in FIG. 2, optimal controlling quantities required for moving the transverse trolley as the operator's notch operation and for stopping the sway of the hoisted load-piece 23. The controller 41 is further to output the optimal controlling quantities as control command signals to the driver 17 for the transverse trolley 11 and the drivers 18, 19 for left and right sheave blocks 14, 15.

Now, description will be made on a specific operational process of sway damping using the swaying hoisted load-piece damping control apparatus of the embodiment described above.

(1) First of all, detectors 31 through 38 and 40 detect the displacement and velocity of the transverse trolley 11, the sheave blocks 14, 15 and the hoisted load-piece 23 and a notch-driving operation quantity and output the detected signals to the controller 41.

Figure 8:
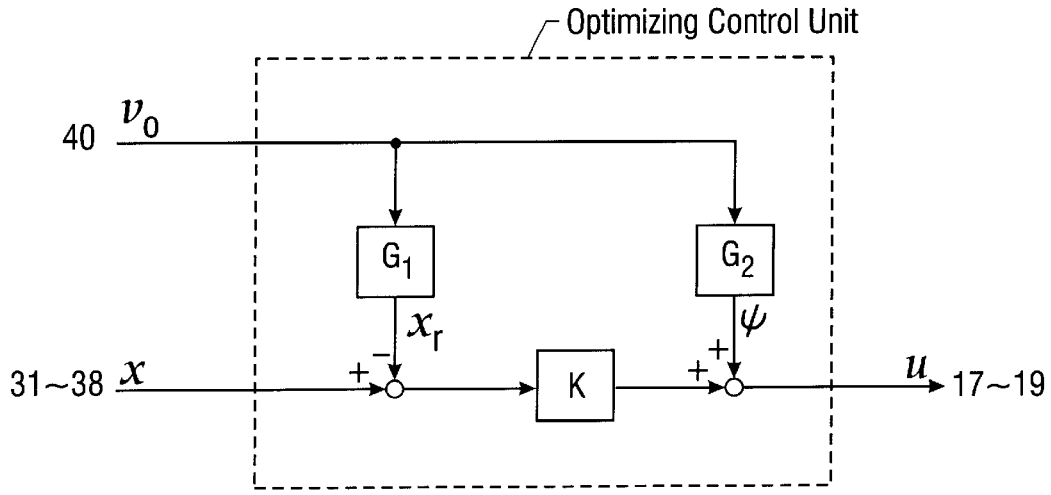
FIG. 8 is a block diagram showing an optimizing control unit of the first through fourth embodiments of the controlling apparatus.

(2) Next, these displacement and velocity and notch-driving operation quantity $v_0$ are used in the optimizing control unit 42 for calculation of optimal sway-damping control to calculate a velocity command $u_0$ for the transverse trolley 11 and velocity commands $u_1$, $u_2$ for the sheave blocks 14, 15 by the following formula [1] as shown in FIG. 8:

$$/K=/K(x-x_r)$$

$$x_r=G_1v_0 \qquad [1]$$

Here, /u represents a controlling (operating) quantity vector shown as follows and the elements are the velocity command $u_0$ for the transverse trolley 11, the velocity command $u_1$ for the left-side sheave block 14 and the velocity command $u_2$ for the right-side sheave block 15, in order from the left, and more explicitly, /u can be defined as the following equation [2]:

$$/u=[u_0\ u_1\ u_2]^T \qquad [2]$$

A condition quantity vector /x is defined as follows. That is, the elements are, in order from the left, a displacement $x_0$ and a velocity *xof the transverse trolley 11, a displacement $x_1$ and a velocity $*x_1$ of the left sheave block 14, a displacement $x_2$ and a velocity $*x_2$ of the right sheave block 15, a displacement $d_1$ and a velocity $*d_1$ of the hoisted load-piece 23 on its left side, and a displacement $d_2$ and a velocity $*d_2$ of the hoisted load-piece 23 on its right side. Explicitly, /x can be expressed as the following equation [3]:

$$/x=[x_0\ \dot{x}_0 x_1\ \dot{x}_1\ x_2\ \dot{x}_2\ d_1\ \dot{d}_1\ d_2\ \dot{d}_2]^T \qquad [3]$$

/xr is a vector as described below. The second element from the left is the notch-driving operation quantity $v_0$. The other elements are equal to zero. /xr is given by multiplying a constant vector $G_1$ described below by the notch-driving operation quantity $v_0$ that is one of input signals.

$$\left.\begin{aligned} x_r &= [0\ v_0\ 0\ 0\ 0\ 0\ 0\ 0\ 0\ 0]^T \\ G_1 &= [0\ 1\ 0\ 0\ 0\ 0\ 0\ 0\ 0\ 0]^T \end{aligned}\right\} \qquad [4]$$

A 3×10 constant matrix /K defined by the following equation represents an optimal gain matrix:

$$\mathbb{K}=\begin{bmatrix} k_{00} & k_{01} & k_{02} & k_{03} & k_{04} & k_{05} & k_{06} & k_{07} & k_{08} & k_{09} \\ k_{10} & k_{11} & k_{12} & k_{13} & k_{14} & k_{15} & k_{16} & k_{17} & k_{18} & k_{19} \\ k_{20} & k_{21} & k_{22} & k_{23} & k_{24} & k_{25} & k_{26} & k_{27} & k_{28} & k_{29} \end{bmatrix} \qquad [6]$$

Here, the constant matrix /K as an optimal gain is to be calculated previously by the following procedures.

Figure 9:
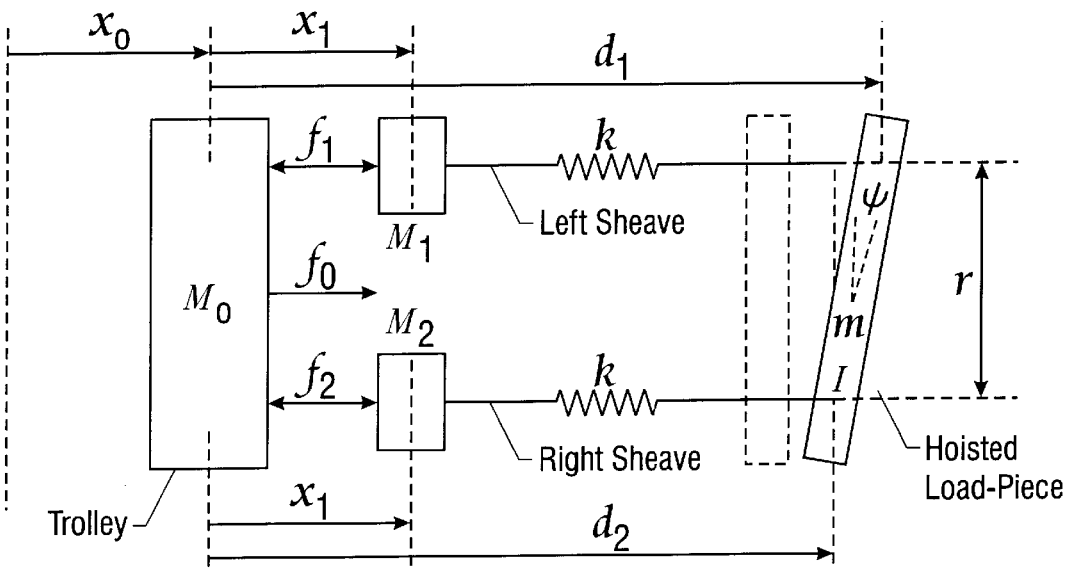
FIG. 9 shows an equivalent model relative to a transverse trolley, left and right sheave blocks and swinging motions on the right and left sides of the hoisted load-piece for deriving a required state equation for determining an optical gain.

1) FIG. 9 shows an equivalent model for the transverse trolley 11, the two (left and right) sheave blocks 14, 15 and swinging motions on the right and left sides of the hoisted load-piece 23.

Here, a pendulum motion of the hoisted load-piece is similar to a spring motion. An equivalent spring constant k is expressed by the equation k=mg/(21) from a wire length l and a mass of hoisted load-piece m. From the equivalent model, the following equations of motion can be derived:

$$\left.\begin{aligned} M_0\ddot{x}_0 &= f_0 - f_1 - f_2 \\ M_1(\ddot{x}_0+\ddot{x}_1) &= f_1 + k(d_1 - x_1) \\ M_2(\ddot{x}_0+\ddot{x}_2) &= f_2 + k(d_2 - x_2) \\ m\left[\ddot{x}_0 + (\ddot{d}_1+\ddot{d}_2)/2\right] &= -k(d_1-x_1) - k(d_2-x_2) \\ I\ddot{\psi} &= k[(d_2-x_2)r/2] - k(d_1-x_i)r/2 \\ \ddot{\psi} &= (d_1-d_2)/r \end{aligned}\right\} \qquad [7]$$

Here, $M_0$ denotes a mass of trolley. $M_1$ and $M_2$ denote masses of left and right sheaves, respectively. m denotes a mass of hoisted load-piece. I denotes moment of inertia of hoisted load-piece. $x_0$ denotes a trolley position. $x_1$ and $x_2$ denote positions of left and right sheaves. $d_1$ and $d_2$ denote sway widths of hoisted load-piece on the left and right sides. ψ denotes a skew angle. γ denotes a length of hoisted load-piece. $f_0$ denotes a trolley drive force. $f_1$ and $f_2$ denote drive forces of left and right sheaves.

From the equations of motion expressed by the equation [7], a state equation is derived where a state vector $x=[x_0\ x^*_0\ x_1^*\ x_1\ x_2\ *x_2\ d_1\ *d_1\ d_2\ *d_2]^T$, which is expressed by the following equation [8]:

$$\dot{x}=\hat{A}x+\hat{B}f \qquad [8]$$

where $\hat{A}$ and $\hat{B}$ are expressed by the following equation [9]:

$$\left.\begin{aligned}
\hat{A} &= \begin{bmatrix}
0 & 1 & 0 & 0 & 0 & 0 & 0 & 0 & 0 & 0 \\
0 & 0 & 0 & 0 & 0 & 0 & 0 & 0 & 0 & 0 \\
0 & 0 & 0 & 1 & 0 & 0 & 0 & 0 & 0 & 0 \\
0 & 0 & -\frac{K}{M_1} & 0 & 0 & 0 & \frac{K}{M_1} & 0 & 0 & 0 \\
0 & 0 & 0 & 0 & 0 & 1 & 0 & 0 & 0 & 0 \\
0 & 0 & 0 & 0 & -\frac{K}{M_2} & 0 & 0 & 0 & \frac{K}{M_2} & 0 \\
0 & 0 & 0 & 0 & 0 & 0 & 0 & 1 & 0 & 0 \\
0 & 0 & \frac{K}{m}+\frac{Kr^2}{4I} & 0 & \frac{K}{m}-\frac{Kr^2}{4I} & 0 & -\left(\frac{K}{m}+\frac{Kr^2}{4I}\right) & 0 & -\left(\frac{K}{m}-\frac{Kr^2}{4I}\right) & 0 \\
0 & 0 & 0 & 0 & 0 & 0 & 0 & 0 & 0 & 1 \\
0 & 0 & \frac{K}{m}-\frac{Kr^2}{4I} & 0 & \frac{K}{m}+\frac{Kr^2}{4I} & 0 & -\left(\frac{K}{m}-\frac{Kr^2}{4I}\right) & 0 & -\left(\frac{K}{m}+\frac{Kr^2}{4I}\right) & 0
\end{bmatrix} \\
\hat{B} &= \begin{bmatrix}
0 & 0 & 0 \\
\frac{1}{M_0} & -\frac{1}{M_0} & -\frac{1}{M_0} \\
0 & 0 & 0 \\
-\frac{1}{M_0} & \frac{1}{M_1}+\frac{1}{M_0} & \frac{1}{M_0} \\
0 & 0 & 0 \\
-\frac{1}{M_0} & \frac{1}{M_0} & \frac{1}{M_0} \\
0 & 0 & 0 \\
-\frac{1}{M_0} & \frac{1}{M_0} & \frac{1}{M_0}
\end{bmatrix}
\end{aligned}\right\} \quad [9]$$

Here, the state vector and drive force vector are represented by the following equation [10]:

$$x = \begin{bmatrix} x_0 \\ x_0 \\ x_1 \\ x_1 \\ x_2 \\ x_2 \\ d_1 \\ d_1 \\ d_2 \\ d_2 \end{bmatrix} \quad f = \begin{bmatrix} f_0 \\ f_1 \\ f_2 \end{bmatrix} \quad [10]$$

On the other hand, the operation quantities of the transverse trolley and the left and right sheave blocks are indicative of the velocity commands $u_0$, $u_1$ and $u_2$. In a velocity controlling system configuration, the following relationship is represented between these velocity commands and the drive forces $f_0$, $f_1$ and $f_2$ applied to the transverse trolley and the left and right sheave blocks:

$$\left.\begin{aligned}
&\text{the transverse trolley} \\
&f_0 = K_{p0}(u_0 - \dot{x}_0) - M_0'\ddot{x}_0 \\
&\text{the left and right sheave blocks} \\
&f_1 = K_{p1}(u_1 - \dot{x}_1) - M_1'\ddot{x}_1 \\
&f_2 = K_{p2}(u_2 - \dot{x}_2) - M_2'\ddot{x}_2
\end{aligned}\right\} \quad [11]$$

Here, $K_{p0}$ denotes a velocity control gain for a trolley drive motor. $K_{p1}$ and $K_{p2}$ denote velocity control gains for the drive motors of the left and right sheave blocks, respectively. $M_0'$ denotes a reduced mass value of moment of inertia of the trolley drive motor. $M_1'$ and $M_2'$ denote reduced mass values of moment of inertia of the left and right sheave blocks, respectively.

Here, the vector of the operation quantities is expressed by the following equation [12]:

$$u = \begin{bmatrix} u_0 \\ u_1 \\ u_2 \end{bmatrix} \quad [12]$$

The following equation [13] indicates the relationship between the velocity commands and drive forces:

$$f = H_1\dot{x} + H_2 x + H_3 u \quad [13]$$

where coefficient matrices $H_1$, $H_2$ and $H_3$ are expressed by the following equation [14]:

$$\left.\begin{aligned}
H_1 &= \begin{bmatrix}
0 & -M_0' & 0 & 0 & 0 & 0 & 0 & 0 & 0 & 0 \\
0 & 0 & 0 & -M_1' & 0 & 0 & 0 & 0 & 0 & 0 \\
0 & 0 & 0 & 0 & 0 & -M_2' & 0 & 0 & 0 & 0
\end{bmatrix} \\
H_2 &= \begin{bmatrix}
0 & -K_{p0} & 0 & 0 & 0 & 0 & 0 & 0 & 0 & 0 \\
0 & 0 & 0 & -K_{p1} & 0 & 0 & 0 & 0 & 0 & 0 \\
0 & 0 & 0 & 0 & 0 & -K_{p2} & 0 & 0 & 0 & 0
\end{bmatrix} \\
H_3 &= \begin{bmatrix}
K_{p0} & 0 & 0 \\
0 & K_{p1} & 0 \\
0 & 0 & K_{p1}
\end{bmatrix}
\end{aligned}\right\} \quad [14]$$

The equation [8] is the equation of state of the transverse trolley, the left and right sheave blocks and the swinging motions on the right and left sides of hoisted load-piece. The equation [13] is a determinant which is indicative of motor velocity controlling systems of the transverse trolley and the left and right sheave blocks. The equation [8] and the equation [13] are combined with each other so as to be integrated. This results in the state equation where the velocity commands are defined as the operation quantities, which is expressed by the following equation [15]:

$$\left.\begin{aligned}\dot{\mathbb{x}} &= \hat{\mathbb{A}}\mathbb{x} + \hat{\mathbb{B}}(\mathbb{H}_1\dot{\mathbb{x}} + \mathbb{H}_2\mathbb{x} + \mathbb{H}_3\mathbb{u})\\ \dot{\mathbb{x}} &= (\mathbb{I} - \hat{\mathbb{B}}\mathbb{H}_1)^{-1}(\hat{\mathbb{A}} + \hat{\mathbb{B}}\mathbb{H}_2)\mathbb{x} + (\mathbb{I} - \hat{\mathbb{B}}\mathbb{H}_1)^{-1}\hat{\mathbb{B}}\mathbb{H}_3\mathbb{u}\end{aligned}\right\} \quad [15]$$

where II denotes a 10×10 unit matrix.

When A and B matrices are defined in the following manner, the state equation is represented by the following equation [16]:

$$\left.\begin{aligned}\mathbb{A} &= (\mathbb{I} - \hat{\mathbb{B}}\mathbb{H}_1)^{-1}(\hat{\mathbb{A}} + \hat{\mathbb{B}}\mathbb{H}_2)\\ \mathbb{B} &= (\mathbb{I} - \hat{\mathbb{B}}\mathbb{H}_1)^{-1}\hat{\mathbb{B}}\mathbb{H}_3\mathbb{u}\\ \dot{\mathbb{x}} &= \mathbb{A}\mathbb{x} + \mathbb{B}\mathbb{u}\end{aligned}\right\} \quad [16]$$

2) Next, an evaluation function J is set up.

$$\left.\begin{aligned}J &= \int_0^\infty (x^T Qx + u^T Ru)\,dt\\ Q &= \mathrm{diag}(q_1\ q_2\ q_3\ q_4\ q_5\ q_6\ q_7\ q_8\ q_9\ q_{10})\\ R &= \mathrm{diag}(r_1\ r_2\ r_3)\end{aligned}\right\} \quad [17]$$

Weighing matrices Q and R are composed of each element which means as follows:

$q_1$, $q_2$: weighing coefficients relative to the trolley position and velocity;

$q_3$, $q_4$: weighing coefficients relative to the displacement and velocity of the left sheave block;

$q_5$, $q_6$: weighing coefficients relative to the displacement and velocity of the right sheave block;

$q_7$, $q_8$: weighing coefficients relative to the sway displacement and velocity of the hoisted load-piece at the left end;

$q_9$, $q_{10}$: weighing coefficients relative to the sway displacement and velocity of the hoisted load-piece at the right end;

$r_1$: weighing coefficient relative to the trolley velocity command;

$r_2$: weighing coefficient relative to the left sheave block velocity command; and $r_3$: weighing coefficient relative to the right sheave block velocity command.

Values of weighing coefficients are set in the following manner.

$q_1$ through $q_{10}$ are to designate a strength of control. For example, when the control for sway damping of the hoisted load-piece is strengthened, $q_7$ through $q_{10}$ are set to larger values.

$r_1$ through $r_3$ are to limit the velocity commands of the transverse trolley and the left and right sheave blocks. For example, when a strict limitation is imposed on the trolley velocity command, $r_1$ is set to the larger value.

These values are adjusted while performing an actual machine test.

3) On the basis of the aforementioned state equation [16], the optimal gain K for minimizing the evaluation function [17] can be determined by the following equation [18]:

$$K = -R^{-1}B^T P \quad [18]$$

where P represents an algebraic matrix Riccati's equation and is a positively symmetric solution of the following equation [19]:

$$A^T P + PA - PBR^{-1}B^T P + Q = 0 \quad [19]$$

(3) The velocity commands $u_0$, $u_1$ and $u_2$ determined by the equation [1] are outputted to the drivers 17, 18 and 19 of the transverse trolley 11 and the left and right sheave blocks 14 and 15, respectively, as the control command signals. These drivers are activated so as to effect the optimal control for sway damping of the hoisted load-piece 23.

Figure 3:
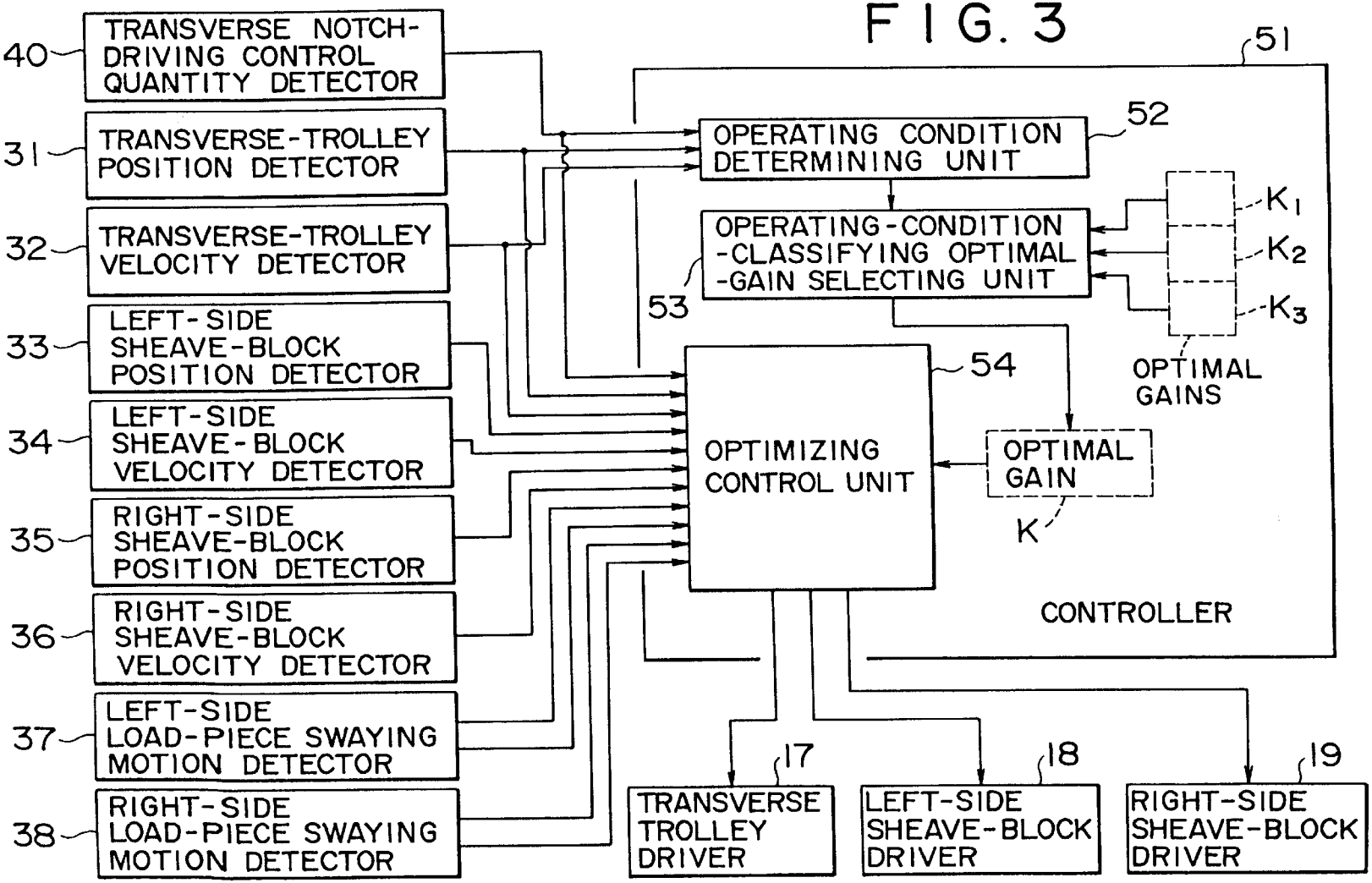
FIG. 3 is a block diagram showing a second embodiment of a controlling apparatus.

FIG. 3 shows a controlling block representing a second embodiment of a swaying hoisted load-piece damping control apparatus of the present invention.

As shown in FIG. 3, in this embodiment, a controller 51 is composed of: an operating condition determining unit 52 which, receiving detected signals from a notch-driving operation quantity detector 40, trolley displacement and velocity detectors 31 and 32, determines the operating condition of a transverse trolley 11 or which condition the transverse trolley 11 is in, specifically, a condition in which the trolley 11 is driven, a condition in which the trolley 11 is in the middle of retardation to stop at a target place or a condition in which the trolley 11 need sway damping after the positioning, to thereby deliver output signals; an operating-condition-classifying optimal-gain selecting unit 53 which, based on the signals from the operating condition determining unit 52 and a plurality of operating-condition-classifying optimal gains $/K_1$, $/K_2$ and $/K_3$ which are previously calculated and set up for the different operating conditions, selects an optimal gain /K for the detected operating condition from the operating-condition-classifying optimal gains $/K_1$, $/K_2$ and $/K_3$; and an optimizing control unit 54 which, receiving the optimal gain /K selected in the operating-condition-classifying optimal-gain selecting unit 53, calculates and sets up optimal controlling quantities in accordance with the detection signals inputted from the detectors 31 through 38 and 40 and outputs the optimal controlling quantities as control command signals to the drivers 17 of the transverse trolley 11, the drivers 18, 19 of respective (left and right) sheave blocks 14, 15.

Now, description will be made on a specific sway-damping process effected by the controller 51 of this embodiment.

(1) The operating condition determining unit 52 determines the operating condition of the transverse trolley 11 based on the detected signals from the notch-driving operation quantity detector 40, the trolley displacement and velocity detectors 31, 32. At that moment, if the operator is performing a notch-driving operation or the notch-driving operation quantity is not zero, the unit 52 judges that the hoisted load-piece 23 is still far from a target position where the load-piece is to be placed on the ground. When the notch-driving operation quantity becomes equal to zero, the unit 52 judges that the load-piece comes near the target position. When the notch-driving operation quantity is equal to zero and the transverse trolley displacement information indicates that the load-piece 23 is at the target position with the transverse velocity equal to zero, the hoisted load-piece 23 is judged as to reach the target position.

(2) The operating-condition-classifying optimal-gain selecting unit 53 selects as the optimal gain /K any one of three optimal gains $/K_1$, $/K_2$ and $/K_3$ in accordance with the operating condition determined in (1). Here, the optimal gains $/K_1$, $/K_2$ and $/K_3$ are determined in the same manner as in the first embodiment. That is, on the basis of the state equation [16] derived from 1) of (2) described in the first embodiment, the equations [18] and [19] in 3) are solved so as to previously determine the optimal gain /K for minimizing the evaluation function [17] which is set up in 2). It should be noted that the evaluation function J is expressed by the following three evaluation functions $J_1$, $J_2$ and $J_3$. In the evaluation function J, the optimal gains are $/K_1$, $/K_2$ and $/K_3$ corresponding to the evaluation functions $J_1$, $J_2$ and $J_3$, respectively.

$$\left.\begin{aligned} J_1 &= \int_0^\infty (x^T Q_1 x + u^T R_1 u)\,dt \\ J_2 &= \int_0^\infty (x^T Q_2 x + u^T R_2 u)\,dt \\ J_3 &= \int_0^\infty (x^T Q_3 x + u^T R u)\,dt \end{aligned}\right\} \quad [20]$$

Here, $/Q_1$ and $/R_1$ are weighing matrices, wherein the first element is equal to zero from the left in the weighing coefficient $/Q_1$ (relative to the trolley position, for a velocity following type optimal-gain calculation mode in which the operator effects notch-driving operation in accordance with the velocity of the transverse trolley 11 without effecting positional control of the transverse trolley 11/$Q_2$ and $/R_2$ are weighing matrices, wherein the first element is not equal to zero from the left in the weighing coefficient $Q_2$ relative to the trolley position, for a positional control type optimal-gain calculation mode in which the transverse trolley 11 is controlled so as to reach the target position. $/Q_3$ and $/R_3$ are weighing matrices, wherein the first and second elements are equal to zero from the left in the weighing coefficient $/Q_3$ relative to the trolley position and velocity and the first element is set to a very large value from the left in the weighing coefficient $/R_3$ relative to the trolley velocity command, for a sway-damping type optimal-gain calculation mode in which the transverse trolley 11 is positioned and sway damping is effected by the sheave blocks 14 and 15 alone.

The weighing matrices $/Q_1$, $/R_1$, $/Q_2$, $/R_2$ and $/Q_3$, $/R_3$ are represented by the following matrices [21]:

$$\begin{aligned} Q_1 &= \mathrm{diag}(0\ q_{21}\ q_{31}\ q_{41}\ q_{51}\ q_{61}\ q_{71}\ q_{81}\ q_{91}\ q_{101}) \\ R_1 &= \mathrm{diag}(r_{11}\ r_{21}\ r_{31}) \\ Q_2 &= \mathrm{diag}(q_{12}\ q_{22}\ {}_{32}\ q_{42}\ q_{52}\ q_{62}\ q_{72}\ q_{82}\ q_{92}\ q_{102}) \\ R_2 &= \mathrm{diag}(r_{12}\ r_{22}\ r_{32}) \\ Q_3 &= \mathrm{diag}(0\ 0\ q_{33}\ q_{43}\ q_{53}\ q_{63}\ q_{73}\ q_{83}\ q_{93}\ q_{103}) \\ R_3 &= \mathrm{diag}(\infty r_{23}\ r_{33}) \end{aligned} \quad [21]$$

The weighing matrices $/Q_1$, $/R_1$, $/Q_2$, $/R_2$ and $/Q_3$, $/R_3$ composed of each element which means, in order from the left, in the same manner as $q_1$ through $q_{10}$ and $r_1$ through $r_3$ described in 2) of (2) of the first embodiment.

In fact, the first element ∞ of $R_3$ is indicative of a very large value. The elements, which are not designated as the value other than 0 or ∞, are adjusted by the actual machine test as described in 2) of (2) of the first embodiment.

(3) The selection of an optimal gain /K by the operating-condition-classifying optimal-gain selecting unit 53 is carried out as follows:

(a) If the load-piece stays far from the target place, the optimal gain $/K_1$ for the velocity following mode in which the operator effects notch-driving operation is selected as the optimal gain /K.

(b) If the load-piece is brought close to the target place, the optimal gain $/K_2$ for the positional control mode in which the transverse trolley 11 is controlled so as to reach the target place is selected as the optimal gain /K.

(c) If the load-piece is positioned at the target place, the optimal gain $/K_3$ for the sway-damping mode in which sway is damped by the sheave blocks 14 and 15 alone is selected as the optimal gain /K.

(4) Then, in the same manner as in the first embodiment, the moving condition quantities and the detection signals detected by the detectors 31 through 38 and 40 are outputted to the controller 51.

(5) From the detection signals inputted, the controller 51 makes the optimizing control unit 54 effect the calculation of the aforementioned equation [1] to determine the velocity command $u_0$ for the transverse trolley 11 and velocity commands $u_1$ and $u_2$ for respective sheave blocks 14 and 15.

(6) Control command signals for velocity commands $u_0$, $u_1$ and $u_2$ are outputted to the drivers 17, 18 and 19 for the transverse trolley 11 and the two (left and right) sheave blocks 14 and 15 so as to drive them, whereby the hoisted load-piece 23 is optimally controlled to stop swinging.

Figure 4:
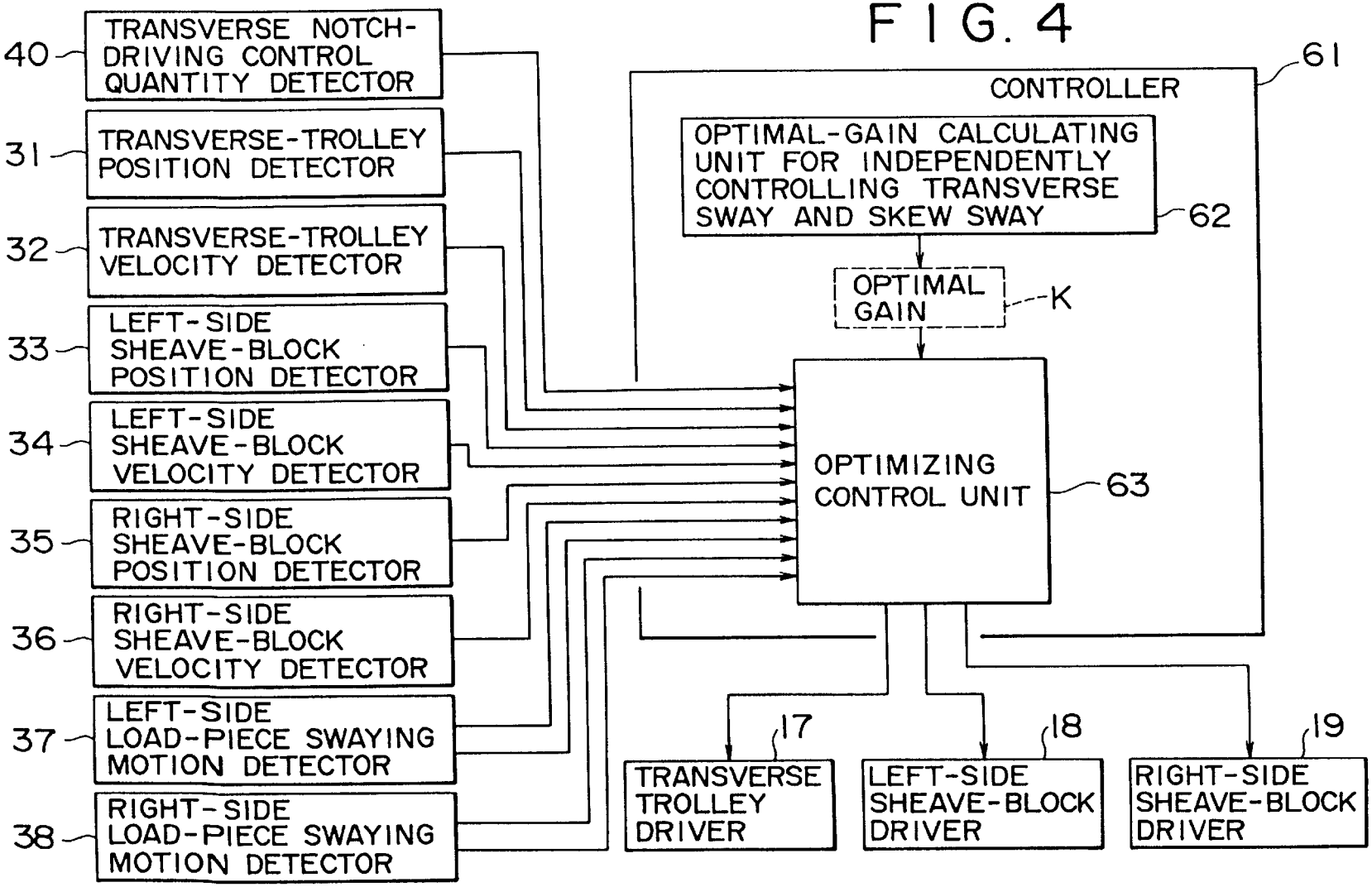
FIG. 4 is a block diagram showing a third embodiment of a controlling apparatus.

FIG. 4 shows a control block representing a third embodiment of a swaying hoisted load-piece damping control apparatus of the present invention.

As shown in FIG. 4, in this embodiment, a controller 61 of the present invention is composed of an optimal-gain calculating unit 62 for independently controlling transverse sway and skew sway in order to calculate and supply optimal gains which are used when the transverse trolley and sheave blocks are driven for damping the transverse sway and skew sway, respectively, that is, when the transverse sway and skew sway are damped independently each from the other by separate drivers and an optimizing control unit 63 for effecting sway-damping control based on the optimal gain K determined by the resulting calculation in the optimal-gain calculating unit 62 for independently controlling transverse sway and skew sway. The optimizing control unit 63 is to, based on the optimal gain /K determined by the optimal-gain calculating unit 62 for independently controlling transverse sway and skew sway in accordance with the signal detected by the detectors 31 through 38 and 40, drive the transverse trolley driver 17 for damping the transverse sway and to drive the left and right sheave block drivers 18 and 19 for damping the skew sway and thereby to effect the damping control.

Now, description will be made on a specific flow of sway damping by the controller 61 of this embodiment. (1) The optimal-gain calculating unit 62 for independently controlling transverse sway and skew sway previously calculates an optimal gain in the following way:

1) In the state equation [16] shown above, if /x is substituted by /x=T/x' to effect a mode transformation, then the following state equation [22] can be obtained. Here, /x' and /T indicate a new condition quantity vector and a mode transforming matrix, respectively.

$$\left.\begin{array}{l}\mathbb{x}' = \mathbb{A}'\mathbb{x}' + \mathbb{B}'\mathbb{u} \\ \text{where} \\ \mathbb{A}' = \mathbb{T}^{-1}\mathbb{A}\mathbb{T} \qquad \mathbb{B}' = \mathbb{T}^{-1}\mathbb{B} \\ \mathbb{x}' = [x_o\ x_o\ x_p\ x_p\ x_s\ x_s\ d_p\ d_p\ d_s\ d_s]^T \\ \mathbb{T} = \begin{bmatrix} 1 & & & & & & & & & \\ & 1 & & & & & & & & \\ & & 1 & 0 & 1 & 0 & & & & \\ & & 0 & 1 & 0 & 1 & & & & 0 \\ & & 1 & 0 & -1 & 0 & & & & \\ & & 0 & 1 & 0 & -1 & & & & \\ & & & & & & 1 & 0 & 1 & 0 \\ & & & & & & 0 & 1 & 0 & 1 \\ & 0 & & & & & 1 & 0 & -1 & 0 \\ & & & & & & 0 & 1 & 0 & -1 \end{bmatrix}\end{array}\right\} \quad [22]$$

$$x_p = \frac{x_1 + x_2}{2}$$

. . . displacement of center positions of the left and right sheave blocks;

$$\dot{x}_p = \frac{\dot{x}_1 + \dot{x}_2}{2}$$

. . . velocity of center positions of the left and right sheave blocks;

$$x_s = \frac{x_1 - x_2}{2}$$

. . . difference of displacements of the left and right sheave blocks $$\dot{x}_s = \frac{\dot{x}_1 - \dot{x}_2}{2}$$

. . . difference of velocities of the left and right sheave blocks $$d_p = \frac{d_1 + d_2}{2}$$

. . . sway component of sway displacement $$\dot{d}_p = \frac{\dot{d}_1 + \dot{d}_2}{2}$$

. . . sway component of sway velocity $$d_s = \frac{d_1 - d_2}{2}$$

. . . skew component of sway displacement $$\dot{d}_s = \frac{\dot{d}_1 - \dot{d}_2}{2}$$

. . . skew component of sway velocity

In one word, a new state equation is derived with respect to a new condition quantity vector /x' whose elements are composed of: $x_0$ and *x0: displacement and velocity of the transverse trolley 11; $x_p$ and $*x_p$: displacement and velocity of the center positions of the left and right sheave blocks 14, 15; $x_s$ and $*x_s$: differences of displacement and velocity of the left and right sheave blocks 14, 15; $d_p$ and $*d_p$: sway components of sway-displacement and sway velocity of the hoisted load-piece 23; and $d_s$ and $*d_s$: skew components of sway displacement and sway velocity of the hoisted load-piece 23.

2) Next, an evaluation function J' is determined.

$$\left.\begin{array}{l} J' = \int_0^\infty (x'^T Q' x' + u^T R u)\, dt \\ Q' = \mathrm{diag}(q'_1\ q'_2\ q'_3\ q'_4\ q'_5\ q'_6\ q'_7\ q'_8\ q'_9\ q'_{10}) \\ R = \mathrm{diag}(r_1\ r_2\ r_3) \end{array}\right\} \quad [23]$$

Weighing matrices Q' and R are composed of each element which means as follows:

- $q'_1$, $q'_2$: weighing coefficients relative to the trolley position and velocity;
- $q'_3$, $q'_4$: weighing coefficients relative to the center positions and velocities of the left and right sheave blocks;
- $q'_5$, $q'_6$: weighing coefficients relative to the difference of displacements and the difference of velocities of the left and right sheave blocks;
- $q'_7$, $q'_8$: weighing coefficients relative to the sway components of sway displacement and sway velocity;
- $q'_9$, $q'_{10}$: weighing coefficients relative to the skew components of sway displacement and sway velocity;
- $r'_1$: weighing coefficient relative to the trolley velocity command;
- $r'_2$: weighing coefficient relative to the left sheave block velocity command; and
- $r'_3$: weighing coefficient relative to the right sheave block velocity command.

3) Here, the optimal allocation of tasks to the transverse trolley and the sheave blocks should be determined in order to achieve optimal control of sway damping. This depends on the setup of the weighing matrix /Q' appearing in the above equation [23].

Sway of the hoisted load-piece 23 during the transverse travel comprises a large transverse swinging motion, generated due to the inertia of the hoisted load-piece 23 when it is accelerated or retarded and a skew swinging motion relatively smaller than the transverse swinging motion, generated due to the eccentricity etc., of the hoisted load-piece 23. In order to damp the large transverse swinging motion, the transverse trolley 11 should be driven so as to effect sway damping since the movement of the sheave blocks 14, 15 is limited within a short stroke on the transverse trolley 11 and therefore can not deal with the large swinging motion. On the other hand, in order to damp the skew swinging motion, the sheave blocks 14 and 15 should be driven so as to effect sway damping since the skew sway is relatively small and the movement of the transverse trolley 11 can not deal with this kind of motion, theoretically.

This allocation of tasks can be achieved by adjusting elements of the weighing matrix Q, specifically, $q'_2$, $q'_4$, $q'_5$ and $q'_6$ as follows.

The elements $q'_3$ and $q'_4$ are the weighing coefficients of the center position and velocity for the left and right sheave blocks 14, 15, and if these elements are taken large, the motion of center position of the left and right sheave blocks 14 and 15 required for damping transverse swinging motion will be limited. Therefore, only the trolley 11 will contribute to controlling the damping operation of transverse swinging motion.

The elements $q'_5$ and $q'_6$ are the weighing coefficients of the difference of displacement and the difference of velocity for the left and right sheave blocks 14, 15, and if these elements are taken small, the opposite-direction movement of the left and right sheave blocks 14 and 15 required for damping skew swinging motion can be secured within the stroke ranges of the sheave blocks 14 and 15. Further, since the transverse trolley 11 cannot contribute to the damping of skew swinging motion theoretically, only the sheave blocks will effectively control the damping operation of skew swinging motion.

The other elements of /Q' and the elements of /R are adjusted by the actual machine test as described in 2) of (2) of the first embodiment.

4) On the basis of the aforementioned state equation [22], the optimal gain /K' for minimizing the evaluation function [23] is determined by the following equation [24]:

$$K'=-R^{-1}B'^{T}P' \quad [24]$$

where P represents the algebraic matrix Riccati's equation and is the positively symmetric solution of the following equation [25]:

$$A'^{T}P'+P'A'-P'B'R^{-1}B'^{T}P'+Q'=0 \quad [25]$$

On the other hand, the optimal gain /K' is for a condition quantity /x' in which a mode transforming is effected. This is expressed by the following equation [26]:

$$/K'/x'=/KT^{-1}/x \quad [26]$$

The optimal gain /K for a condition quantity /x can be determined prior to the mode transformation by the following equation:

$$/K=/KT^{-1}$$

(2) Then, in the same manner as in the first embodiment, the signals detected by the detectors 31 through 38 and 40 are outputted to the controller 61.

(3) From the signals inputted, the controller 61 makes the optimizing control unit 63 effect the calculation of sway-damping optimizing control based on the aforementioned equation [1] to determine the velocity command $u_0$ for the transverse trolley 11 and velocity commands $u_1$ and $u_2$ for respective (left and right) sheave blocks 14 and 15.

(4) Control command signals for velocity commands $u_0$, $u_1$ and $u_2$ are outputted to the drivers 17, 18 and 19 for the transverse trolley 11 and the two (left and right) sheave blocks 14 and 15, whereby the hoisted load-piece 23 is optimally controlled to stop swinging.

Figure 5:
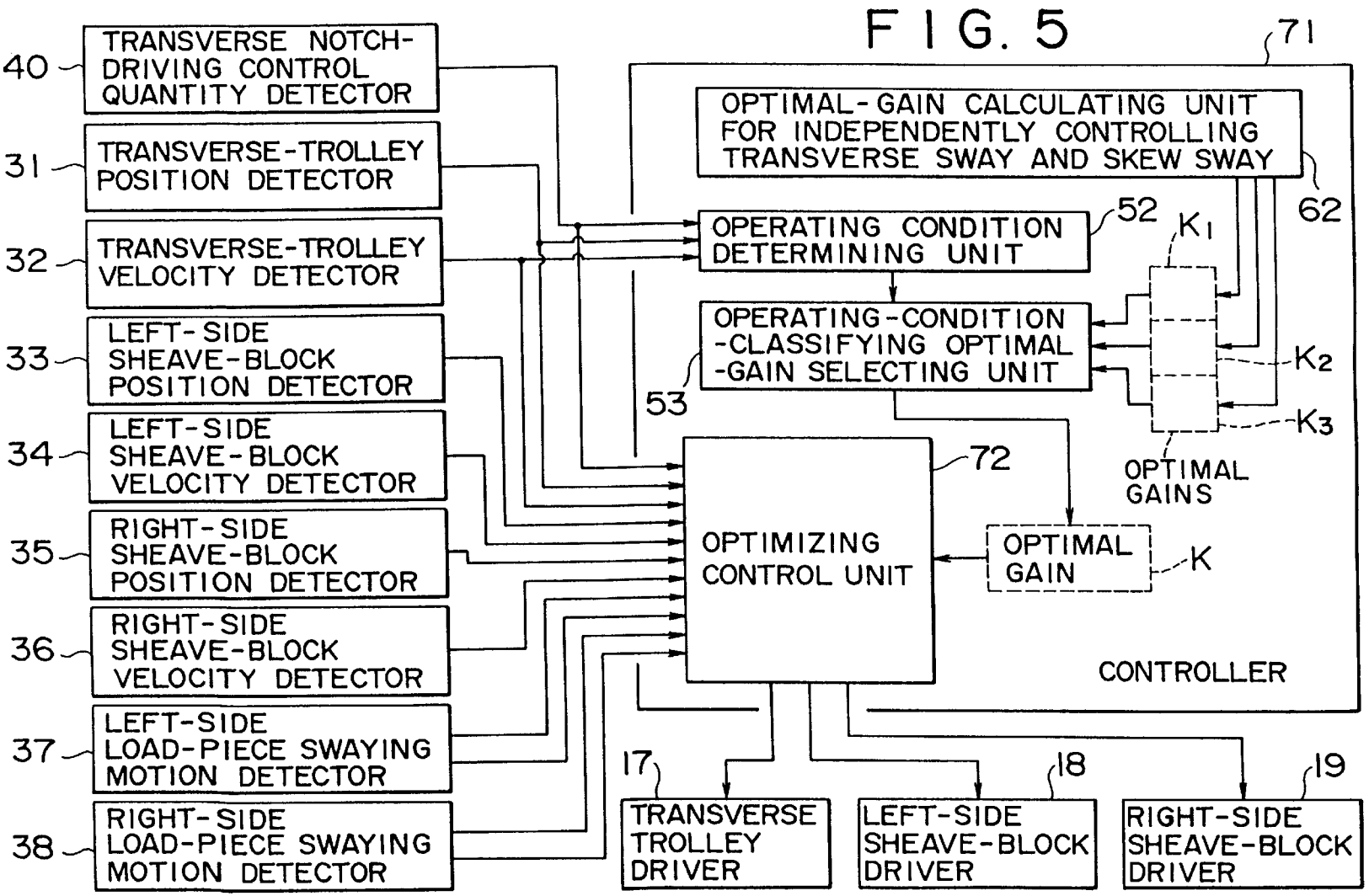
FIG. 5 is a block diagram showing a fourth embodiment of a controlling apparatus.

FIG. 5 shows a control block representing a fourth emrbodiment of a swaying hoisted load-piece damping control apparatus of the present invention.

As shown in FIG. 5, a controller 71 of this embodiment is has combined features of the controllers 51 and 62 described in the second and third embodiments.

Specifically, in the controller 71, an optimizing control unit 72, as receiving detection signals from the detectors 31 through 38 and 40, sets up optimal controlling qualities referring to an optimal gain /K for operating condition classifying and for independently controlling transverse sway and skew sway which is determined according to both the operating condition and swinging modes (i.e., the transverse swinging motion and the skew swinging motion) as executed in the controllers 51 and 61 of the second and third embodiments. With the thus determined optimal controlling quantities, the controller 71 effects sway-damping control.

Now, description will be made on a specific sway-damping process effected by the controller 71 of this embodiment.

In the optimal-gain calculating unit 62 for independently controlling transverse sway and skew sway, an optimal gain is previously determined in the following manner.

1) The state equation [22] is derived in the manner as in the third embodiment.

2) Next, evaluation functions $J'_1$ and $J'_2$ are set up as follows:

$$\left.\begin{aligned} J'_1 &= \int_0^\infty (x'^T Q'_1 x' + u^T R_1 u)\,dt \\ J'_2 &= \int_0^\infty (x'^T Q'_2 x' + u^T R_2 u)\,dt \\ Q'_1 &= \mathrm{diag}(0\ q'_{21}\ q'_{31}\ q'_{41}\ q'_{51}\ q'_{61}\ q'_{71}\ q'_{81}\ q'_{91}\ q'_{101}) \\ R_1 &= \mathrm{diag}(r_{11}\ r_{21}\ r_{31}) \\ Q'_2 &= \mathrm{diag}(q'_{12}\ q'_{22}\ q'_{32}\ q'_{42}\ q'_{52}\ q'_{62}\ q'_{72}\ q'_{82}\ q'_{92}\ q'_{102}) \\ R_2 &= \mathrm{diag}(r_{12}\ r_{22}\ r_{32}) \end{aligned}\right\} \quad [27]$$

Weighing matrices /Q'1, /R1, /Q'2, /R2 are composed of each element which, in order from the left, has the same meaning as $q'_1$ through $q'_{10}$ and $r_1$ through $r_3$ described in 2) of (1) of the third embodiment.

Here, the optimal allocation of tasks to the transverse trolley and the sheave blocks should be determined in order to achieve optimal control of sway damping. In the same manner described in 3) of (1) of the third embodiment, $q'_{31}$, $q'_{41}$, $q'_{51}$, $q'_{61}$, $q'_{32}$, $q'_{42}$, $q'_{52}$, $q'_{62}$ are set up so as to determine a weighing matrix for driving the transverse trolley and the sheave blocks so as to damp the transverse sway and the skew sway, respectively, whereby effecting a control of damping sway.

Furthermore, as described in (2) of the second embodiment, the first element is equal to zero from the left of $/Q'_1$, and the first element is set to a value other than zero from the left of $/Q'_1$. In such a manner, $/Q'_1$ and $/R_1$ are set to velocity following type optimal-gain calculation mode weighing matrices. $/Q'_2$ and $/R_2$ are set to positional control type optimal-gain calculation mode weighing matrices.

The other elements are to be adjusted by the actual machine test as described in 2) of (2) of the first embodiment.

3) On the basis of the state equation [22], the optimal gains $/K'_1$ and $/K'_2$ for minimizing the evaluation functions $J'_1$ and $J'_2$ represented by the equation [27] are determined by the following equation [28]:

$$\left.\begin{aligned} \mathbb{K}'_1 &= -\mathbb{R}_1^{-1}\mathbb{B}'^T\mathbb{P}'_1 \\ \mathbb{K}'_2 &= -\mathbb{R}_2^{-1}\mathbb{B}'^T\mathbb{P}'_2 \end{aligned}\right\} \quad [28]$$

where $/P_1'$ and $/P_2$ represent the algebraic matrix Riccati's equations and are the positively symmetric solutions of the following equation [29]:

$$\left.\begin{aligned} \mathbb{A}'^T\mathbb{P}'_1 + \mathbb{P}'_1\mathbb{A}' - \mathbb{P}'_1\mathbb{B}'\mathbb{R}_1^{-1}\mathbb{B}'^T\mathbb{P}'_1 + \mathbb{Q}'_1 = 0 \\ \mathbb{A}'^T\mathbb{P}'_2 + \mathbb{P}'_2\mathbb{A}' - \mathbb{P}'_2\mathbb{B}'\mathbb{R}_2^{-1}\mathbb{B}'^T\mathbb{P}'_2 + \mathbb{Q}'_2 = 0 \end{aligned}\right\} \quad [29]$$

On the other hand, the optimal gains $/K_1$ and $/K_2$ are for a condition quantity /x' in which the mode transforming is effected. This is expressed by the following equation [30]:

$$/K'_1/x'=/K'_1T^{-1}/x,\ /K'_2/x'=/K'_2T^{-1}/x \quad [30]$$

The optimal gains $/K'_1$ and $/K'_2{}^1$ for a condition quantity /x can be determined prior to the mode transformation by the following equation:

$$/K_1=/K'_1T^{-1},\ /K_2=/K'_2T^{-1}$$

Furthermore, an optimal gain $/K_3$, which allows the transverse trolley to stop for damping sway by the sheave blocks 14, 15 alone, is previously determined in accordance with (2) of the second embodiment.

(2) The operating condition determining unit 52 determines operating condition of the transverse trolley 11 in the manner described in (1) of the second embodiment.

(3) The operating-condition-classifying optimal-gain selecting unit 53 selects an optimal gain /K in the manner described in (3) of the second embodiment.

(4) In the same manner as in the first embodiment, the detection signals detected by the detectors 31 through 38 and 40 are outputted to the controller 71.

(5) From the detection signals inputted, the controller 71 makes the optimizing control unit 72 effect the calculation of the equation [1] to determine the velocity command $u_0$ for the transverse trolley 11 and velocity commands $u_1$ and $u_2$ for respective left and right sheave blocks 14 and 15.

(6) Control command signals for velocity commands $u_0$, $u_1$ and $u_2$ are outputted to the drivers 17, 18 and 19 for the transverse trolley 11 and the left and right sheave blocks 14 and 15, whereby the hoisted load-piece 23 is optimally controlled to stop swinging.

As has been described in detail referring to the embodiments, the first feature of the swaying hoisted load-piece damping control apparatus of the present invention is equipped with a transverse trolley having a pair of sheave blocks which are disposed on both sides of the transverse trolley and movable relative to the transverse trolley and further comprises: different kinds of detectors such as for detecting displacement and velocity of the transverse trolley, detecting sway displacement and velocity on right and left sides of the load-piece and detecting moving condition quantities displacement and velocity of the right and left sheave blocks; a notch disposed on an operation controlling panel of the transverse trolley, for setting a trolley transverse velocity by an operator; a transverse notch-driving control quantity detector for outputting signals indicative of notch-driving control quantity (a trolley transverse velocity set value) which is set by operating the notch; and a controller for effecting sway-damping control of a load-piece hoisting device based on detection signals obtained from the detectors, and is constructed such that the controller has an optimizing control unit which sets up optimal controlling quantities for the hoisted load-piece in accordance with the signals detected from the detectors, on the basis of a preset optimal gain for sway damping, and performs sway-damping control by driving the transverse trolley and the sheave blocks by the setup optimal controlling quantities. Therefore, it is possible to establish easy sway-damping control of the hoisted load piece in an assured manner by automating the sway-damping control of the hoisted load-piece which has been difficult in the prior art. Further, it is possible to realize the optimal sway-damping control which can damp the sway of the hoisted load-piece as fast as possible and to inhibit the load-piece from swinging. As a result, the work amount of the operator as well as the time required for sway damping can be markedly decreased, thereby making it possible to improve the conveying efficiency of hoisted load-pieces.

In accordance with the second feature of the swaying hoisted load-piece damping control apparatus of the present invention, the controller comprises: an operating condition determining unit which detects the operating condition of the transverse trolley, based on the displacement, velocity and notch-driving control quantity for the transverse trolley; an operating-condition-classifying optimal-gain selecting unit which, in accordance with the operating condition detected by the operating condition determining unit, selects an operating-condition-classifying optimal gain for sway damping; and an optimizing control unit which, based on the optimal gain outputted from the operating-condition-classifying optimal-gain selecting unit, sets up optimal controlling quantities for the hoisted load-piece and performs sway-damping control by driving the transverse trolley and the sheave blocks in accordance with the setup optimal controlling quantities. Therefore, as described above, the work amount of the operator as well as the time required for sway damping can be markedly decreased, thereby making it possible to improve the conveying efficiency of hoisted load-pieces. In addition, during the transverse trolley travels transversally, a velocity following type optimal control is effected so that the transverse trolley quickly reacts to the operator's notch operation, thereby allowing operability to be improved. During the stop, a positional control type optimal control is effected so that the hoisted load-piece does not pass but reaches the target position, thereby allowing safety to be improved. After the stop, an optimal control for damping sway of the sheave blocks alone is effected so that the operator cab connected to the transverse trolley is not moved, thereby allowing the cab to be more comfortable.

In accordance with the third feature of the swaying hoisted load-piece damping control apparatus of the present invention, the controller comprises: an independently controlling optimal-gain calculating unit which drives the transverse trolley and the sheave blocks for damping transverse sway and skew sway, respectively, that is, calculates independent optimal gains used to control transverse sway and skew sway of the hoisted load-piece, independently one from the other by separate drivers and outputs the calculated optimal gains; and an optimizing control unit for effecting sway-damping control which, based on the optimal gains outputted from the independently controlling optimal-gain calculating unit, sets up optimal controlling quantities for hoisted load-piece and effects sway-damping control by driving the transverse trolley to damp transverse sway of the load-piece and driving the right and left sheave blocks to damp skew sway of the load-piece. Therefore, as described above, the work amount of the operator as well as the time required for sway damping can be markedly decreased, thereby making it possible to improve the conveying efficiency of hoisted load-pieces. In addition, for damping a large transverse sway caused during the transverse travel, the sheave blocks are not driven since they are moved within short stroke ranges alone. Therefore, the transverse trolley is used for damping sway. Thus, during the transverse travel, the movement of the sheave blocks for damping skew swinging motion can be secured within the stroke ranges of the sheave blocks. Accordingly, during the transverse travel, performance for damping skew sway is improved.

In accordance with the fourth feature of the swaying hoisted load-piece damping control apparatus of the present invention, the controller comprises: an independently controlling optimal-gain calculating unit which drives the transverse trolley and the sheave blocks for damping transverse sway and skew sway, respectively, that is, calculates independent optimal gains used to control transverse sway and skew sway of the hoisted load-piece, independently one from the other by separate drivers and outputs the calculated optimal gains; an operating condition determining unit which detects the operating condition of the transverse trolley, based on the displacement, velocity and notch-driving control quantity; an operating-condition-classifying optimal-gain selecting unit which, in accordance with the operating condition detected by the operating condition determining unit, selects a preset operating-condition-classifying optimal gain or an operating-condition-classifying optimal gain set up by the independently controlling optimal-gain calculating unit and outputs the selected gain; and an optimizing control unit which, based on the optimal gain outputted from the operating-condition-classifying optimal-gain selecting unit, sets up optimal controlling quantities for the hoisted load-piece and performs sway-damping control by driving the transverse trolley and the sheave blocks in accordance with the setup optimal controlling quantities. Therefore, as described above, the work amount of the operator as well as the time required for sway damping can be markedly decreased, thereby making it possible to improve the conveying efficiency of hoisted load-pieces. In addition, during the transverse trolley travels transversally, a velocity following type optimal control is effected so that the transverse trolley quickly reacts to the operator's notch operation, thereby allowing operability to be improved. During the stop, a positional control type optimal control is effected so that the hoisted load-piece does not pass but reaches the target position, thereby allowing safety to be improved. After the stop, an optimal control for damping sway of the sheave blocks alone is effected so that the operator cab connected to the transverse trolley is not moved, thereby allowing the cab to be more comfortable. Furthermore, for damping a large transverse sway caused during the transverse travel, the sheave blocks are not driven since they are moved within short stroke ranges alone. Therefore, the transverse trolley is used for damping sway. Thus, during the transverse travel, the movement of the sheave blocks for damping skew swinging motion can be secured within the stroke ranges of the sheave blocks. Accordingly, during the transverse travel, performance for damping skew sway is improved.

What is claimed is:

1. A damping control apparatus for use in a device for hoisting a load-piece, said device having a transverse trolley being transversally movable and a driver thereof, and a pair of right and left sheave blocks which are disposed along the moving directions of said transverse trolley and movable relative to said transverse trolley and a driver for each sheave block, said apparatus comprising:

a trolley displacement detector for detecting a displacement of said transverse trolley;

a trolley velocity detector for detecting a velocity of said trolley;

a sway detector for detecting the displacement of a sway of the load-piece hoisted by said device;

a sway velocity detector for detecting the velocity of a sway of the load-piece hoisted by said device;

a sheave block displacement detector for detecting displacement of said right and left sheave blocks;

a sheave block velocity detector for detecting velocity of said right and left sheave blocks;

an operation controlling panel and an operator velocity control disposed on said operation controlling panel of said device, allowing an operator to select a setting for a trolley transverse velocity;

a velocity setting detector for outputting signals indicative of the operator's panel setting for the trolley transverse velocity;

a controller for effecting sway-damping control of said load-piece hoisting device based on detection signals obtained from said detectors, said controller having an optimizing control unit which sets up optimal controlling quantities for the hoisted load-piece in accordance with the actual displacement and velocity detected by said trolley, sway, and sheave block velocity and displacement detectors, on the basis of a preset optimal gain for sway damping for the detected operator velocity setting, and performs sway-damping control by driving said transverse trolley and said sheave blocks through said drivers in accordance with the optimal controlling quantities;

an operating condition determining unit which detects the operating condition of said transverse trolley, based on the displacement and velocity and the notch-driving operation quantity for said transverse trolley;

operating-condition-classifying optimal-gain selecting unit which, in accordance with the operating condition detected by said operating condition determining unit, selects an operating-condition-classifying optimal gain for sway damping from a plurality of predetermined optimal gains; and an optimizing control unit which, based on the optimal gain outputted from said operating-condition-classifying optimal-gain selecting unit, sets up optimal controlling quantities for the hoisted load-piece and performs sway-damping control by driving said transverse trolley and said sheave blocks in accordance with the setup optimal controlling quantities.

* * * * *